United States Patent [19]

Heyn

[11] 4,427,128

[45] Jan. 24, 1984

[54] CAN AND CLOSURE THEREFOR

[75] Inventor: William M. Heyn, New Canaan, Conn.

[73] Assignee: The Continental Group, Inc., Stamford, Conn.

[21] Appl. No.: 434,156

[22] Filed: Oct. 13, 1982

[51] Int. Cl.[3] ..... B65D 17/34

[52] U.S. Cl. ..... 220/270; 220/306

[58] Field of Search ..... 220/270, 306

[56] References Cited

U.S. PATENT DOCUMENTS

| | | | |
|---|---|---|---|
| 3,049,264 | 8/1962 | Morawski | 220/60 |
| 3,142,280 | 7/1964 | Heinle | 113/121 |
| 3,318,477 | 5/1967 | Southwick, Jr. et al. | 220/47 |
| 3,331,528 | 7/1967 | Racek | 220/67 |
| 3,701,453 | 10/1972 | Platt el al. | 220/54 |
| 4,171,062 | 10/1979 | Allen et al. | 220/270 |
| 4,238,047 | 12/1980 | Helms et al. | 220/306 |
| 4,289,252 | 9/1981 | Helms | 220/306 |

FOREIGN PATENT DOCUMENTS

| | | |
|---|---|---|
| 638233 | 3/1962 | Canada . |
| 1307999 | 9/1962 | France . |

*Primary Examiner*—George T. Hall

*Attorney, Agent, or Firm*—Charles E. Brown

[57] ABSTRACT

A closure for a can in which the can comprises a circumscribing curl which interlocks with a sealing flange breakable upon lifting of the closure and which serves to hold the closure in closed position.

6 Claims, 4 Drawing Figures

CAN AND CLOSURE THEREFOR

BACKGROUND OF THE INVENTION

This invention is directed to closures for cans and more specifically to closures which are resealable and which when initially assembled provide a good pressure seal for items such as tennis balls. Currently, such cans have a metal top of the type known as a fully open end. Such ends are not reclosable and require an edge protector to prevent the user from being cut.

SUMMARY OF THE INVENTION

This invention is concerned with a novel closure assembly wherein the closure is in the form of a cap having a top wall and a peripheral skirt, the top wall being seated against a preformed open curl provided at the top edge portion of the side wall of a can and the skirt overlapping the top edge portion and having a bead which is entered into the curl which then is squeezed closed about the bead to provide a seal-tight connection.

The invention comprehends providing on the skirt an internal radial flange with the bead being formed on the inner edge of the flange which has a score formed therein intermediate its inner and outer edges such that the flange will easily tear when the cap is being pulled off from the top of the can. A part of the flange remains within the skirt of the cap and serves to lock under the curl when the cap is reapplied after opening.

These and other objects and advantages inherent in and encompassed by the invention will become more apparent from the specification and the drawings, wherein.

DESCRIPTION OF FIGS. 1–3

Figure 1:
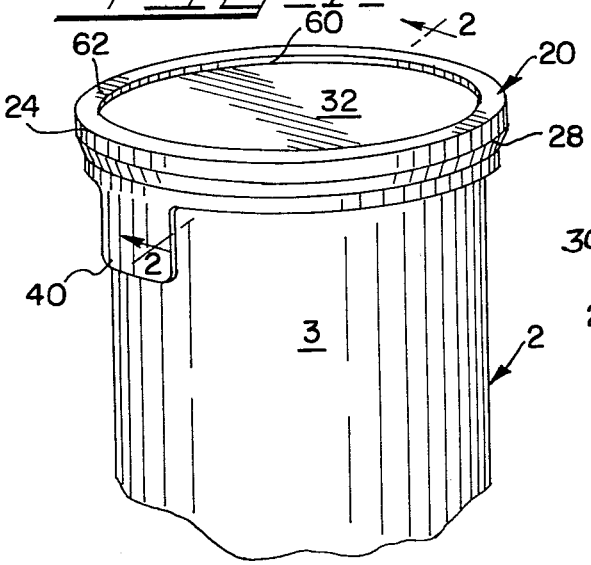
FIG. 1 is a perspective view of my novel container and cap assembly.

In the drawings the can 2 comprises a can body wall 3 having the usual integral bottom (not shown).

The top of the can is formed with a peripheral outturned flange 5 which is formed integral with a short downturned axial skirt wall 6, the lower edge of which is formed with an inturned ledge 8 which is connected to a rectangular shaped channel 10 closely embracing the can body wall 3. The channel has a pair of vertically space outer clamp strip webs 12, 13, top and bottom walls 14, 15, and an inner wall 16. The channel is tucked into the space between the skirt wall 6 and the body wall 3 and upper and lower clamping strip webs 12 and 13 define an outwardly open annular seal receiving gap or entryway 18 immediately below the ledge 8.

A cap or closure 20 is fitted on the upper edge portion generally designated 22 of the can. The closure 20 comprises an annulus or collar portion 24 which is made from flexible plastic such as polyethylene. The annulus 24 comprises a skirt section 25 which is provided intermediate its top and bottom ends with an integral annular inwardly extending securing flange 26 normal to the axis of the can.

Figure 2:
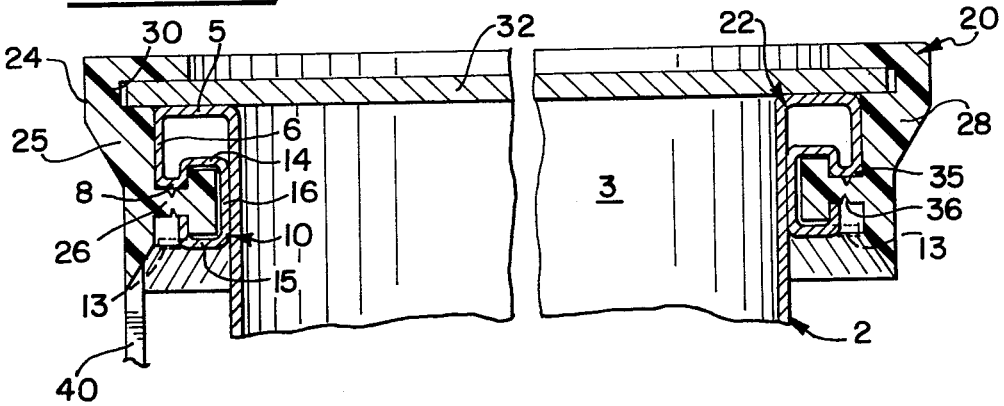
FIG. 2 is an enlarged cross-sectional view taken substantially on line 2—2 of FIG. 1.

The inner edge of the flange 26 is formed with a rectangular bead which fits complimentally within the channel 10 which initially has the lower clamping flange 13 extending horizontally as seen in dotted lines in FIG. 2 and is then swagged or crimped upwardly to close the gap and to firmly clamp flange 26 against the ledge 8 to obtain an air-tight seal.

The skirt annulus 24 is made of thicker section at its upper portion 28 and has an internal groove 30. A flat metal disk 32 such as aluminum is fitted within the annulus and extends at its peripheral edge 34 into the groove 30 with a sealtight fit. If desired, the disk edge may be adhesively bonded to the groove surfaces.

Figure 3:
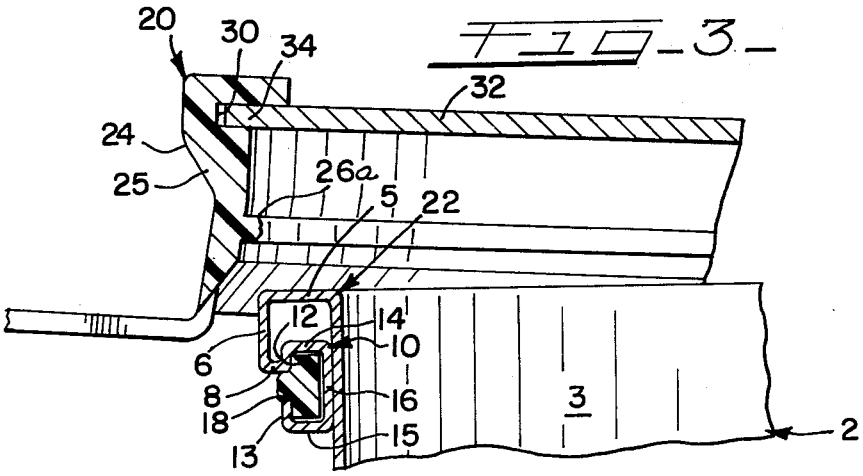
FIG. 3 is a fragmentary sectional view such as FIG. 3 showing the parts in open position.

Referring to FIG. 2, it will be noted that the securing flange has upper and lower axially aligned weakening notches or scores 35, 36 therein between its inner and outer edges such that the securing flange can be torn apart as seen in FIG. 3 by lifting on the tab 40 which extends downwardly from the annulus.

After opening, the cap may be again fitted onto the upper end portion of the can whereupon the portion **26*a*** of the securing flange is stretched over the skirt wall of the can until it snaps under the ledge.

DESCRIPTION OF FIG. 4

Figure 4:
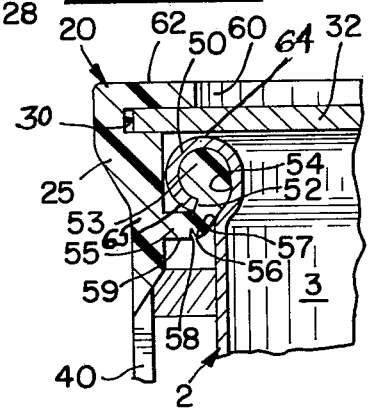
FIG. 4 is a cross-sectional view illustrating another modification of the invention.

The embodiment of FIG. 4 is similar to FIGS. 1–3 and therefore like parts will be identified with the same reference numerals.

In this embodiment the upper end portion of the can is formed with a curl or channel 50 of cylindrical cross-section and provides a downwardly facing gap 52. A complimentary bead 53 extends into the hollow 54 of the curl or channel and the securing and sealing flange 55 is clamped between the free edge 56 of the channel and the opposing terminus 57 of the channel formed from the can body wall to provide a sealtight connection. The securing flange has an annular weakening notch or score 58 on its underside 59 and that when the cover is lifted upwardly, the score will break and the cover may be removed. To reclose, the cover is fitted onto the upper end of the can body as in FIGS. 1–3 until the securing flange portion **55*a*** snaps under the curl.

In this embodiment the disk 32 is last inserted with groove 30 leaving an unobstructed opening 60 in the top wall 62 of the closure. A suitable tool may be applied against the top 64 and inside surface 65 of the curl to close the gap 52 to obtain a tight seal. Thereafter, the disk 32 is forced into the groove 30 by stretching the wall portion 62 and the disk sealed therein.

Several embodiments of the invention have been disclosed. It will be apparent that other modifications can be made which fall within the scope of the appended claims.

What is claimed is:

1. A closure for a can and the like wherein the can has a body wall and an upper edge channel formation thereabout providing a seal-means-receiving gap therein, a cap fitted over said upper edge portion and having sealing means entered into said channel formation through said gap in a sealtight fit therewith, said sealing means being adapted to be torn apart attendant to lifting off of said cap to open the can.

2. The invention according to claim 1 and said sealing means having a remaining portion on said cap after being torn apart for interlocking engagement with said channel formation for retaining the cap on said can after reclosure.

3. The invention according to claim 1 and said cap having a plastic skirt portion and said means comprising a flange extending radially inwardly from said skirt.

4. The invention according to claim 3 and said flange having a weakening score therein to facilitate tearing thereof.

5. The invention according to claim 1 and said formation being of rectangular section and comprising upper and lower clamping strips defining said gap and being bendable for clamping engagement with the flange.

6. A closure for a container having an upper end portion including a channel formation with an entryway, a cap fitted on the upper end portion comprising a stretchable plastic skirt having a sphinctural grip about said upper end portion and comprising a sealing flange extending through said entryway into said channel formation and being tightly clamped by opposing portions of said channel, said flange being tearable apart attendant to lifting of the cap from said container.

* * * * *